US012084233B2

(12) United States Patent
Huang

(10) Patent No.: US 12,084,233 B2
(45) Date of Patent: Sep. 10, 2024

(54) WATER BOTTLE CAP

(71) Applicant: CHEN WHUA INTERNATIONAL CO., LTD., Tainan (TW)

(72) Inventor: Yi-Jen Huang, Tainan (TW)

(73) Assignee: CHEN WHUA INTERNATIONAL CO., LTD., Tainan (TW)

( * ) Notice: Subject to any disclaimer, the term of this patent is extended or adjusted under 35 U.S.C. 154(b) by 55 days.

(21) Appl. No.: 17/994,000

(22) Filed: Nov. 25, 2022

(65) Prior Publication Data

US 2024/0174413 A1 May 30, 2024

(51) Int. Cl.
*B65D 47/24* (2006.01)
*B65D 47/18* (2006.01)

(52) U.S. Cl.
CPC ..... *B65D 47/248* (2013.01); *B65D 47/185* (2013.01)

(58) Field of Classification Search
CPC .... B65D 47/248; B65D 47/185; B65D 47/24; B65D 47/20; B65D 47/04; B65D 47/18; B65D 47/06; B65D 1/02; B65D 11/04; B65D 41/026
See application file for complete search history.

(56) References Cited

U.S. PATENT DOCUMENTS

2006/0231572 A1* 10/2006 Mallet ..... B65D 47/248 222/92
2007/0028988 A1* 2/2007 Mihashi ..... B65D 23/02 139/383 A
2007/0062906 A1* 3/2007 Morano ..... B65D 47/2031 220/717
2007/0090044 A1* 4/2007 Mihashi ..... A61F 9/0008 210/473
2007/0267383 A1* 11/2007 McGeough ..... B65D 47/06 215/273
2008/0073383 A1* 3/2008 McDonald ..... B65D 49/04 222/500
2009/0032533 A1* 2/2009 Kessell ..... A61F 5/4405 251/309
2009/0101617 A1* 4/2009 Viggiano ..... A47G 19/2266 215/200
2009/0173755 A1* 7/2009 Ogawa ..... B65D 47/248 222/546
2010/0116852 A1* 5/2010 Painchaud ..... B65D 47/18 222/496
2010/0207046 A1* 8/2010 Wenchell ..... B67D 7/0294 251/315.1
2015/0122845 A1* 5/2015 Uetake ..... A61F 9/0008 222/189.06

* cited by examiner

*Primary Examiner* — Kareen K Thomas
(74) *Attorney, Agent, or Firm* — Leong C. Lei

(57) ABSTRACT

A water bottle cap includes a cap body including a space, an upper hole member through a top and communicating with the space of the cap body, a plurality of apertures spaced around and through the top, and a lower through hole communicating with both the space of the cap body and an internal space of a bottle, and a valve moveably disposed in the cap body and comprising an axial flow channel, a tube disposed through the hole member into the space of the cap body, an annular flange extending outward from an outer surface of the tube into the space of the cap body, and a bottom extension extending downward from a joining portion of the tube and the annular flange into the through hole. The valve is configured to move to a closed position, a spraying position, or an open position relative to the cap body.

15 Claims, 5 Drawing Sheets

WATER BOTTLE CAP

FIELD OF THE INVENTION

The invention relates to water bottle caps and more particularly to a cap mounted on a top of a water bottle having improved characteristics.

BACKGROUND OF THE INVENTION

A wide variety of water bottles are commercially available. A type of water bottle for athletes comprises a bottle for containing water and a cap releasably mounted on a top opening of the bottle. The cap includes a cap body having a channel, and a pushbutton type outlet mounted on the body. An individual may press the outlet to block the channel, thereby preventing water in the bottle from being discharged. In use, the individual may pull the outlet to unblock the channel, thereby flowing water out of the bottle.

Body temperature will slightly increase when an individual is in a muggy environment or after exercising. The individual may drink water to quench thirst by opening the water bottle. However, the body temperature is still high and the individual may feel a degree of uneasiness. Additionally, the individual may lift the open water bottle to pour water on the face or the body part to decrease the body temperature. However, the poured water may dampen the clothes if sufficient care is not taken.

Thus, the need for improvement still exists.

SUMMARY OF THE INVENTION

The invention has been made in an effort to solve the problems of the conventional art by providing a water bottle cap having novel and nonobvious characteristics.

To achieve above and other objects of the invention, the invention provides a water bottle cap disposed on a top opening of a bottle including an internal space for containing liquid, comprising a cap body comprising a space, an upper hole member through a top and communicating with the space of the cap body, a plurality of apertures spaced around the top, the apertures having a diameter less than that of the hole member, and a lower through hole communicating with both the space of the cap body and the internal space of the bottle; and a valve moveably disposed in the cap body and comprising an axial flow channel, a tube disposed through the hole member into the space of the cap body, an annular flange extending outward from an outer surface of the tube into the space of the cap body, and a bottom extension extending downward from a joining portion of the tube and the annular flange into the through hole; wherein the valve is configured to move to a closed position, a spraying position, or an open position relative to the cap body; wherein in the closed position the annular flange moves downward away from the apertures to block the through hole, the liquid in the internal space is prevented from flowing into the space of the cap body and the apertures, the axial flow channel is blocked by the bottom extension, and the liquid is prevented from flowing to the axial flow channel; wherein in the spraying position the annular flange moves upward away from the through hole to unblock the apertures, the liquid in the internal space flows through the through hole into the space of the cap body and further flows through the apertures, the axial flow channel is blocked by the bottom extension, and the liquid is prevented from flowing to the axial flow channel; and wherein in the open position the annular flange blocks the apertures, the through hole is blocked by the bottom extension, the liquid in the internal space is prevented from flowing into the space of the cap body and further flows through the apertures, the bottom extension is not blocked, and the liquid flows to the axial flow channel.

The invention has the following advantages and benefits in comparison with the conventional art: the valve can be operated to move to a closed position, a spraying position, or an open position. In the open position, water flows through the axial channel to be consumed by an individual. In the spraying position, fine drops of water are scattered from the apertures.

The above and other objects, features and advantages of the invention will become apparent from the following detailed description taken with the accompanying drawings

DETAILED DESCRIPTION OF THE INVENTION

Figure 1:
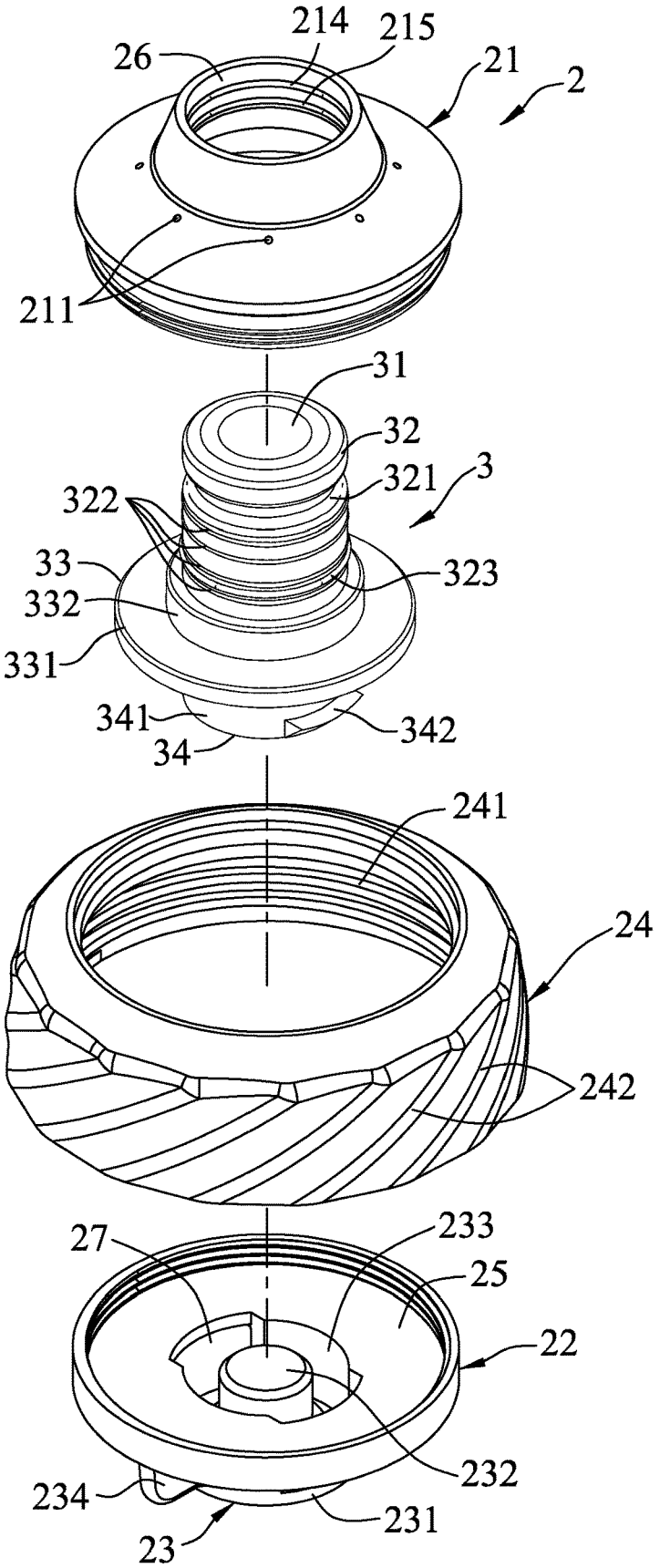
FIG. 1 is an exploded view of a water bottle cap of a preferred embodiment of the invention, viewed from the top.
Figure 2:
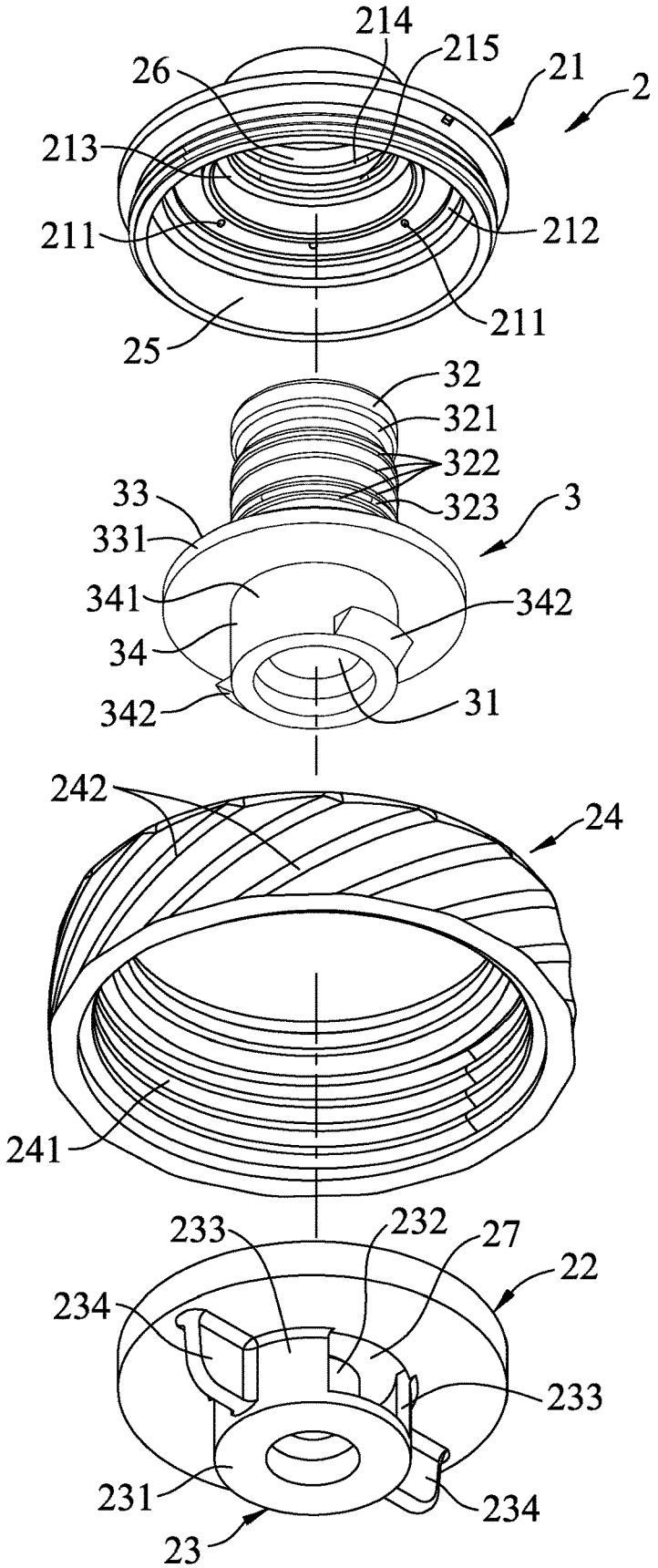
FIG. 2 is an exploded view of a water bottle cap of the invention, viewed from the bottom.

Referring to FIGS. 1 to 5, a water bottle cap of a preferred embodiment of the invention is shown. The water bottle cap is mounted on a top opening of a bottle 1 which includes an internal space 11 for containing liquid (e.g., water or drink). The water bottle cap comprises a cap body 2 and a valve 3 as discussed in detail below.

The cap body 2 includes an annular upper member 21, an annular lower member 22, a hollow block 23 provided on a central portion of a bottom of the lower member 22, and a ring 24 extending downward from the upper member 21. A space 25 is defined by both the upper member 21 and the lower member 22. A hole member 26 is provided on a top of the upper member 21 and is above the space 25. A through hole 27 is defined by both the lower member 22 and the block 23, is under the space 25, and communicates with the space 11.

The upper member 22 includes a plurality of equally spaced holes 211 on a top with the hole member 26 being surrounded. The apertures 211 communicate with the space 25. An outer tunnel 212 is provided under the apertures 211 and communicates with the apertures 211. An inner tunnel 213 is provided between the hole member 26 and the apertures 211. A concave upper snapping element 214 and a concave lower snapping element 215 are provided on an annular inner surface of the hole member 26. A diameter of the aperture 211 is less than that of the hole member 26. In the embodiment, both the upper snapping element 214 and the lower snapping element 215 are annular grooves.

The hollow block 23 includes an annular limit member 231 on a bottom under the through hole 27, a hollow shaft 232 extending upward toward the through hole 27 from an inner surface of the limit member 231, two opposite connection elements 233 interconnecting the lower member 22 and the limit member 231, and two opposite ribs 234 each extending outward from the connection element 233 and formed with the lower member 22.

The ring 24 includes an internally threaded member 241 on an inner surface configured to releasably secured to an externally threaded neck of the bottle 1, and a knurled member 242 on an outer surface.

It is noted that the upper member 21 and the lower member 22 are threadedly secured together at their edges. The ring 24 is fastened by both the upper member 21 and the lower member 22. In the embodiment, the cap body 2 comprises the annular upper member 21, the annular lower member 22, the hollow block 23, and the ring 24 for the sake of manufacture and receiving the valve 3. In practice, the cap body 2 may have other components not limited to the above. Also, the number, the shapes and the connection relationships of the components may be changed. For example, the ring 24 can be integrally formed with the annular upper member 21 of the annular lower member 22 and a detailed description thereof is omitted herein for the sake of brevity.

The valve 3 is tubular and integrally formed of rubber or silicone. The valve 3 is moveably mounted in the cap body 2 and comprises an axial flow channel 31 aligned with the block 23 below, a tube 32 disposed through the hole member 26 into the space 25, an intermediate, annular flange 33 extending outward from an outer surface of the tube 32 into the space 25, and a bottom extension 34 extending downward from a joining portion of the tube 32 and the annular flange 33 into the through hole 27 to put on the block 23.

The tube 32 includes an annular groove 321 on an outer surface above the cap body 2, a plurality of spaced annular ridges 322 on the outer surface under the annular groove 321, and a convex annular positioning member 323 on the outer surface between two adjacent ones of the annular ridges 322. In the embodiment, the finger, the mouth or the teeth can grasp the annular groove 321 to pull the valve 3. In practice, the structure and the number of the above components of the tube 32 are not limited to above. The annular ridges 322 urge against the outer surface of the hole member 26 to either position or block flow by flexibly deforming the valve 3. It is noted that the number of the annular ridges 322 is not limited to a specific number. In practice, the number of the annular ridges 322 is at least one. The convex annular positioning member 323 is inserted into the concave upper snapping element 214 or the concave lower snapping element 215. In another embodiment, the annular positioning member 323 is concave and each of the upper snapping element 214 and the lower snapping element 215 are convex.

The annular flange 33 has a stepped-diameter configuration and includes an outward extending valve part 331 and an outward extending sealing part 332 above the valve part 331.

The bottom extension 34 includes a hollow cylinder 341 inserted into the through hole 27 to dispose on the hollow shaft 232, and two opposite latches 342 on an outer surface adjacent to a bottom, the latches 342 having a sharp end and each disposed between the connection elements 233, i.e., between the lower member 22 and the limit member 231. The number of the latches 342 is not limited to two. It can be one or more than two depending on the number or the shapes of the connection elements 233.

Figure 4:
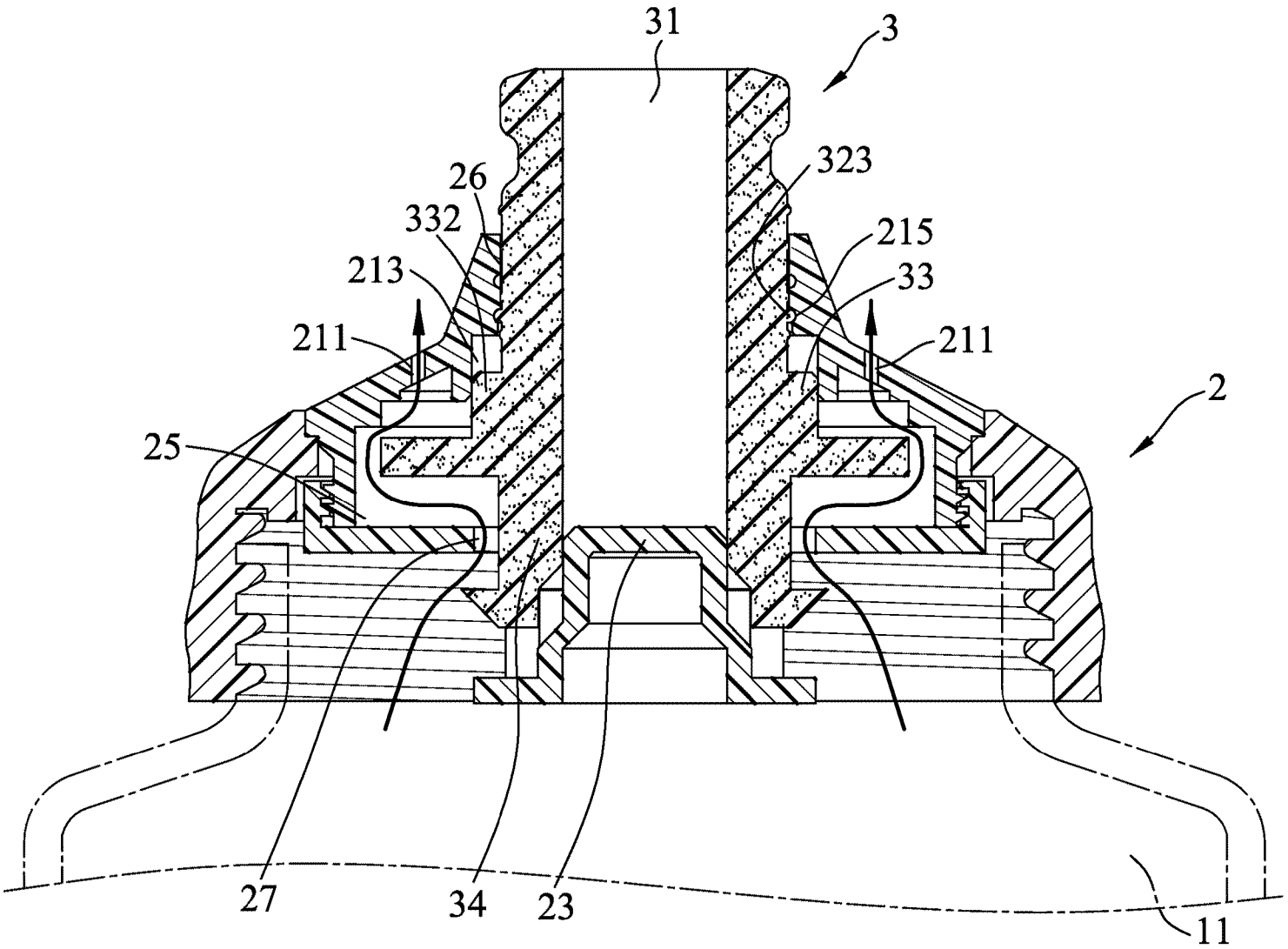
FIG. 4 is a view similar to FIG. 3 showing the valve in a spraying position.
Figure 5:
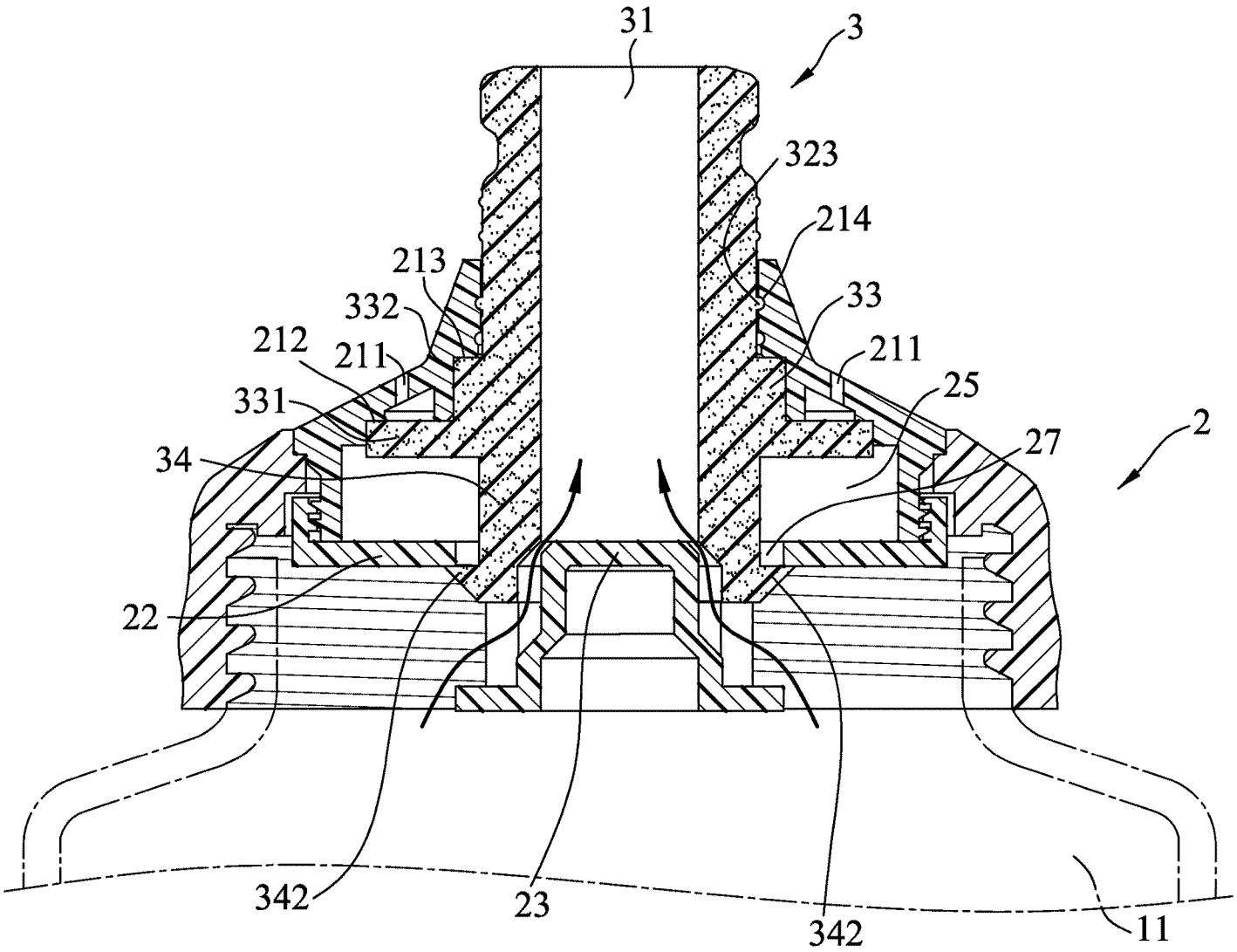
FIG. 5 is a view similar to FIG. 3 showing the valve being open.

In use, the valve 3 can be moved relative to the cap body 2 to dispose as being closed (see FIG. 3), in a configuration to spray (see FIG. 4), or as being open (see FIG. 5).

Figure 3:
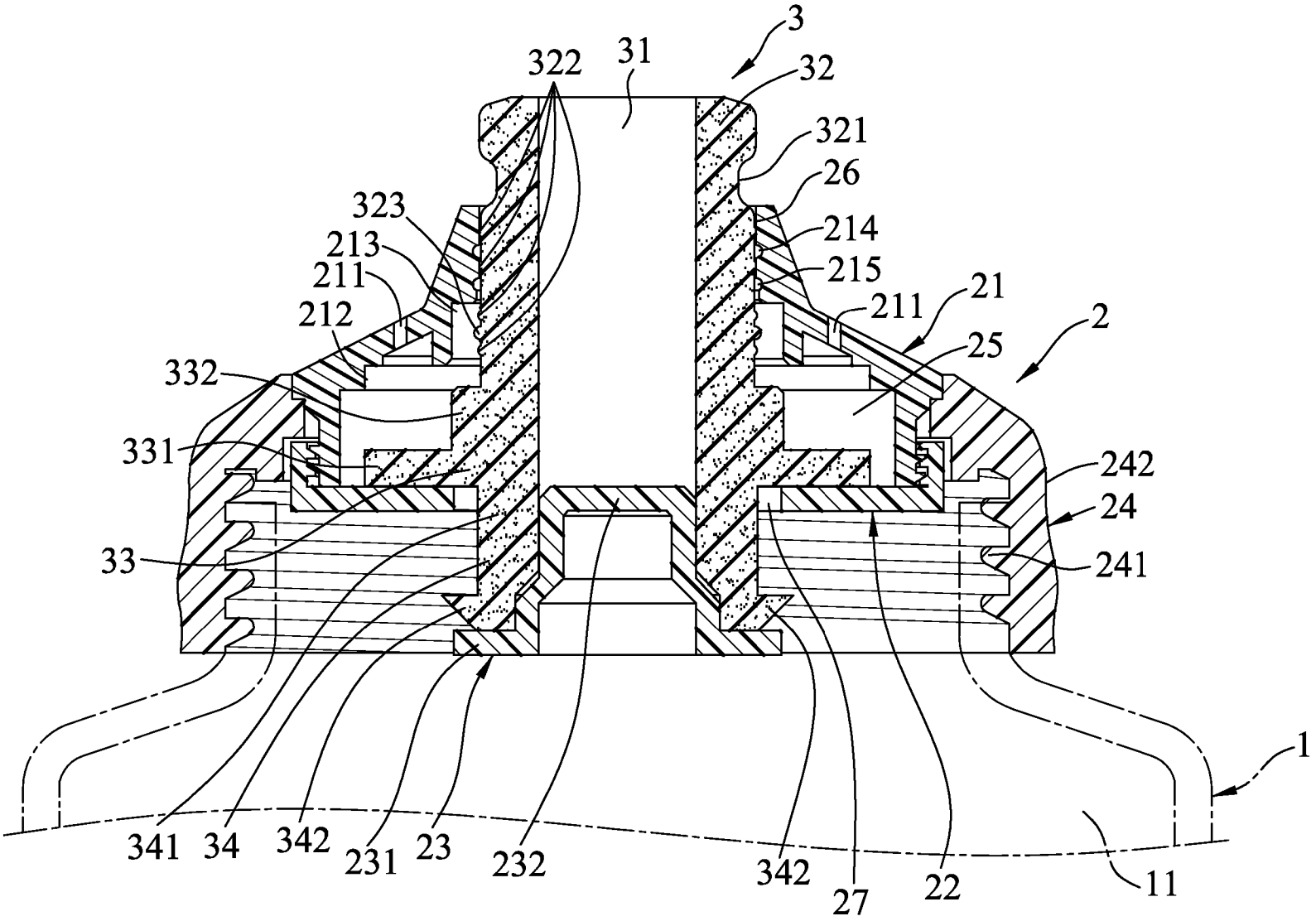
FIG. 3 is a longitudinal sectional view of the assembled water bottle cap showing the valve being closed.

As shown in FIG. 3 specifically, an individual may press the valve 3 to a closed position when the individual does not want to drink water stored in the water bottle or spray water out of the water bottle. In detail, the annular flange 33 moves downward away from the apertures 211 to be stopped by a top of the lower member 22. At this position, the through hole 27 is blocked and the outward extending sealing part 332 disengages from the inner tunnel 213. Thus, water stored in the space 11 is prevented from flowing into the space 25 and the apertures 211. The bottom extension 34 is disposed on the hollow block 23 to block the axial flow channel 31. Thus, water does not flow to the axial flow channel 31. The annular ridges 322 urge against the outer surface of the hole member 26 and the latches 342 urge against the annular limit member 231. As a result, the valve 3 is closed.

As shown in FIG. 5 specifically, the individual may pull the valve 3 to an open position when the individual wants to drink water stored in the water bottle. At this open position, the convex annular positioning member 323 is disposed in the concave upper snapping element 214. Also, the outward extending valve part 331 urges against the outer tunnel 212, the outward extending sealing part 332 urges against the inner tunnel 213, the annular flange 33 blocks the apertures 211, the latches 342 urge against the lower member 22, the through hole 27 is blocked by the bottom extension 34. Thus, water stored in the space 11 is prevented from flowing into the space 25 and the apertures 211. The bottom extension 34 is disengaged from the hollow block 23 to unblock the axial flow channel 31. Thus, water flows to the axial flow channel 31. As a result, the individual may drink the discharged water.

As shown in FIG. 4 specifically, the individual may pull the valve 3 to a position for spraying when the individual wants to spray water onto the body to decrease body temperature. At this spraying position, the convex annular positioning member 323 is disposed in the concave lower snapping element 215. Also, the annular flange 33 moves upward away from the through hole 27 to unblock the apertures 211. Thus, water stored in the space 11 flows through the through hole 27 into the space 25 and further flows through the apertures 211 to spray water on the body of the individual, thereby lowering the body temperature. Water does not flow to axial flow channel 31 because the bottom extension 34 engages the hollow block 23 to unblock the axial flow channel 31. The outward extending sealing part 332 urges against a portion of the inner tunnel 213 and thus water in the space 25 does not flow through a gap between the valve 3 and the hole member 26.

The invention has the following advantages and benefits in comparison with the conventional art: the valve 3 can be operated to move to a closed position, a spraying position, or an open position. In the open position, water flows through the axial flow channel 31 to be consumed by an individual. In the spraying position, fine drops of water are scattered from the apertures 211. Thus, the clothes worm on the individual is prevented from being dampened.

While the invention has been described in terms of preferred embodiments, those skilled in the art will recognize that the invention can be practiced with modifications within the spirit and scope of the appended claims.

What is claimed is:

1. A water bottle cap disposed on a top opening of a bottle including an internal space for containing liquid, comprising:

a cap body comprising a space, an upper hole member through a top and communicating with the space of the cap body, a plurality of apertures spaced around the top, the apertures having a diameter less than that of the upper hole member, and a lower through hole communicating with both the space of the cap body and the internal space of the bottle; and a valve moveably disposed in the cap body and comprising an axial flow channel, a tube disposed through the upper hole member into the space of the cap body, an annular flange extending outward from an outer surface of the tube into the space of the cap body, and a bottom extension extending downward from a joining portion of the tube and the annular flange into the through hole;

wherein the valve is configured to move to a closed position, a spraying position, or an open position relative to the cap body;

wherein in the closed position, the annular flange moves downward away from the apertures to block the through hole, the liquid in the internal space is prevented from flowing into the space of the cap body and the apertures, the axial flow channel is blocked by the bottom extension, and the liquid is prevented from flowing to the axial flow channel;

wherein in the spraying position, the annular flange moves upward away from the through hole to unblock the apertures, the liquid in the internal space flows through the through hole into the space of the cap body and further flows through the apertures, the axial flow channel is blocked by the bottom extension, and the liquid is prevented from flowing to the axial flow channel; and wherein in the open position, the annular flange blocks the apertures, the through hole is blocked by the bottom extension, the liquid in the internal space is prevented from flowing into the space of the cap body and further flows through the apertures, the bottom extension is not blocked, and the liquid flows to the axial flow channel.

2. The water bottle cap of claim 1, wherein the cap body further comprises an annular upper member with the upper hole member disposed therein and the apertures disposed therethrough, an annular lower member releasably secured to the upper member, a hollow block provided on a central portion of a bottom of the annular lower member and disposed at a bottom of the axial flow channel; wherein the space of the cap body is defined by both the upper member and the lower member; wherein the through hole is defined by both the lower member and the hollow block; wherein when the valve is in each of the closed position and the spraying position, the bottom extension is blocked by the hollow block; and wherein when the valve is in the open position, the bottom extension clears the hollow block.

3. The water bottle cap of claim 2, wherein the apertures are disposed around the upper hole member; wherein the upper member includes an outer tunnel under the apertures and communicating with the apertures; the annular flange includes an outward extending valve part; wherein when the valve is in the closed position, the outward extending valve part blocks the through hole; and wherein when the valve is in the open position, the outward extending valve part blocks the outer tunnel.

4. The water bottle cap of claim 3, wherein the upper member includes an inner tunnel between the upper hole member and the apertures; wherein the annular flange further comprises an outward extending sealing part above the valve part; wherein when the valve is in the closed position, the sealing part clears the inner tunnel; and wherein when the valve is in each of the spraying position and the open position, the sealing part blocks the inner tunnel.

5. The water bottle cap of claim 2, wherein the upper member includes a concave upper snapping element and a concave lower snapping element on an annular inner surface of the upper hole member; wherein the tube includes a convex annular positioning member on an outer surface; wherein when the valve is in the spraying position, the convex annular positioning member is disposed in the concave lower snapping element; and wherein when the valve is in the open position, the convex annular positioning member is disposed in the concave upper snapping element.

6. The water bottle cap of claim 3, wherein the upper member includes a concave upper snapping element and a concave lower snapping element on an annular inner surface of the upper hole member; wherein the tube includes a convex annular positioning member on an outer surface; wherein when the valve is in the spraying position, the convex annular positioning member is disposed in the concave lower snapping element; and wherein when the valve is in the open position, the convex annular positioning member is disposed in the concave upper snapping element.

7. The water bottle cap of claim 4, wherein the upper member includes a concave upper snapping element and a concave lower snapping element on an annular inner surface of the upper hole member; wherein the tube includes a convex annular positioning member on an outer surface; wherein when the valve is in the spraying position, the convex annular positioning member is disposed in the concave lower snapping element; and wherein when the valve is in the open position, the convex annular positioning member is disposed in the concave upper snapping element.

8. The water bottle cap of claim 5, wherein the tube further comprises at least one annular ridge on the outer surface, the at least one annular ridge urging against an outer surface of the upper hole member.

9. The water bottle cap of claim 6, wherein the tube further comprises at least one annular ridge on the outer surface, the at least one annular ridge urging against an outer surface of the upper hole member.

10. The water bottle cap of claim 7, wherein the tube further comprises at least one annular ridge on the outer surface, the at least one annular ridge urging against an outer surface of the upper hole member.

11. The water bottle cap of claim 2, wherein the hollow block includes an annular limit member on a bottom under the through hole; wherein the bottom extension includes at least one latch on an outer surface adjacent to a bottom, the at least one latch having a sharp end; wherein when the valve is in the closed position, the at least one latch urges against the limit member; and wherein when the valve is in the open position, the at least one latch urges against the lower member.

12. The water bottle cap of claim 1, wherein the tube includes an annular groove on an outer surface above the cap body.

13. The water bottle cap of claim 11, wherein the tube includes an annular groove on an outer surface above the cap body.

14. The water bottle cap of claim 1, wherein the valve is integrally formed of rubber or silicone.

15. The water bottle cap of claim 2, wherein the cap body further comprises a ring extending downward from the upper member, the ring including an internally threaded member configured to releasably secured to the bottle.

* * * * *